US006866002B1

(12) United States Patent
Christy et al.

(10) Patent No.: US 6,866,002 B1
(45) Date of Patent: Mar. 15, 2005

(54) RIVAL FLAG

(76) Inventors: Raymond D. Christy, 516 Cypress View Dr., Oldsmar, FL (US) 34677; Salvador J. Palmisano, 2036 Carmel Valley Dr., Laplace, LA (US) 70068

( * ) Notice: Subject to any disclaimer, the term of this patent is extended or adjusted under 35 U.S.C. 154(b) by 0 days.

(21) Appl. No.: 10/759,142

(22) Filed: Jan. 20, 2004

(51) Int. Cl.[7] ..... G09F 17/00
(52) U.S. Cl. ..... 116/173
(58) Field of Search ..... 116/173–175, 28 R; 40/603, 604, 907; D11/165–180

(56) References Cited

U.S. PATENT DOCUMENTS

| | | | | | |
|---|---|---|---|---|---|
| D27,006 | S | * | 5/1897 | Perkins | D11/173 |
| 1,232,120 | A | * | 7/1917 | Sutter, Jr. | 40/495 |
| D62,092 | S | | 3/1923 | Pope | |
| D132,707 | S | * | 6/1942 | Ziegler | D11/133 |
| D134,583 | S | * | 12/1942 | Woodward | D11/168 |
| 3,766,854 | A | * | 10/1973 | Scarlet | 101/211 |
| 4,108,311 | A | * | 8/1978 | McClendon | 206/573 |
| 4,177,750 | A | * | 12/1979 | Scarlet | 116/173 |
| 4,637,151 | A | * | 1/1987 | Love et al. | 40/584 |
| 4,774,869 | A | | 10/1988 | Riksford | |
| 4,964,360 | A | * | 10/1990 | Henry | 116/28 R |
| 5,207,174 | A | * | 5/1993 | Fabbrini | 116/173 |
| 5,454,120 | A | * | 10/1995 | Rowlands | 2/195.1 |
| 5,517,941 | A | * | 5/1996 | Fisher | 116/173 |
| 5,881,391 | A | | 3/1999 | Mullaney | |
| D471,840 | S | * | 3/2003 | Sylvester | D11/180 |
| 2002/0073914 | A1 | | 6/2002 | Kinahan | |

FOREIGN PATENT DOCUMENTS

| | | |
|---|---|---|
| JP | 2002040973 | 2/2002 |

* cited by examiner

*Primary Examiner*—R. Alexander Smith
(74) *Attorney, Agent, or Firm*—Richard C. Litman

(57) ABSTRACT

The rival flag is made from a sheet of material having a parallelogram shape. A diagonal line divides the parallelogram into first and second complementary, triangular-shaped pennants. Each pennant has indicia marked thereon representing one of two opposing teams. The indicia on the two pennants face opposite directions. Thus, when the rival flag is oriented such that the first pennant is on top and the second pennant is on the bottom, indicia on the first pennant is displayed right side up while indicia on the second pennant is displayed upside down. When the rival flag is oriented such that the second pennant is on top and the first pennant is on the bottom, indicia on the second pennant is displayed right side up while indicia on the first pennant is displayed upside down.

13 Claims, 4 Drawing Sheets

RIVAL FLAG

BACKGROUND OF THE INVENTION

1. Field of the Invention

The present invention relates to a flag, and more particularly, to a flag that depicts indicia associated with two rival parties and distinguishes between two rival parties. The rival flag has the shape of a parallelogram divided by a diagonal to form two triangular pennants the logos for two different teams, one right side up and the other inverted, so that the logo which is right side up indicates the winning team and the inverted logo indicates the losing team.

2. Description of the Related Art

Sports enthusiasts have long sought novel ways to express loyalty to their teams through displaying logo-bearing flags, pennants, and other paraphernalia at sports events, in the home, in the car, or various other locations. The advent of formal licensing programs by sports teams at all levels of competition, both amateur and professional, along with the increased following of team sports by the general population, has resulted in increased popularity of such products. However, while such products convey the loyalties of an individual or a group to others, they serve little other purpose.

A flag or pennant, having the logo or name of two opposing teams displayed thereon in such a manner as to distinguish between the winning and losing teams is desirable.

U.S. Pat. No. 5,881,391, issued Mar. 16, 1999 to D. W. Mullaney, discloses a pair of flags bearing a sports team's colors and/or logo and a pair of upstanding standards for carrying the flags. The standards are removably secured to the opposing sides of the visor of a baseball or similar type cap.

U.S. Pat. No. 4,774,869, issued Oct. 4, 1988 to J. Riksford, discloses a multi-flag marching baton. The baton is configured to display one flag while the other flag is stored within. When the baton's telescoping members are pulled apart, the second flag is displayed while causing the first flag to be stored within the baton itself.

Other patents relating to pennants and related paraphernalia include Des. 62,092, issued Mar. 13, 1923 to W. M. Pope (pennant); U.S. Pat. No. 2002/0073914 A1, issued Jun. 20, 2002 to B. Kinahan (apparatus for supporting a banner unfurled); and Japanese Patent No. 2002-40,973, published Feb. 8, 2002 (a cheering flag).

None of the above inventions and patents, taken either singly or in combination, is seen to describe the instant invention as claimed. Thus a rival flag solving the aforementioned problems is desired.

SUMMARY OF THE INVENTION

The rival flag is made from a sheet of material having a parallelogram shape. A diagonal line divides the parallelogram into first and second complementary, triangular-shaped pennants. Each pennant has indicia marked thereon representing one of two opposing teams. The indicia on the two pennants face opposite directions. Thus, when the rival flag is oriented such that the first pennant is on top and the second pennant is on the bottom, indicia on, the first pennant is displayed right side up while indicia on the second pennant is displayed upside down. When the rival flag is oriented such that the second pennant is on top and the first pennant is on the bottom, indicia on the second pennant is displayed right side up while indicia on the first pennant is displayed upside down.

By orienting the rival flag such that the pennant for the winning team is on top, the rival flag may be used to indicate the winner of two opposing teams.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
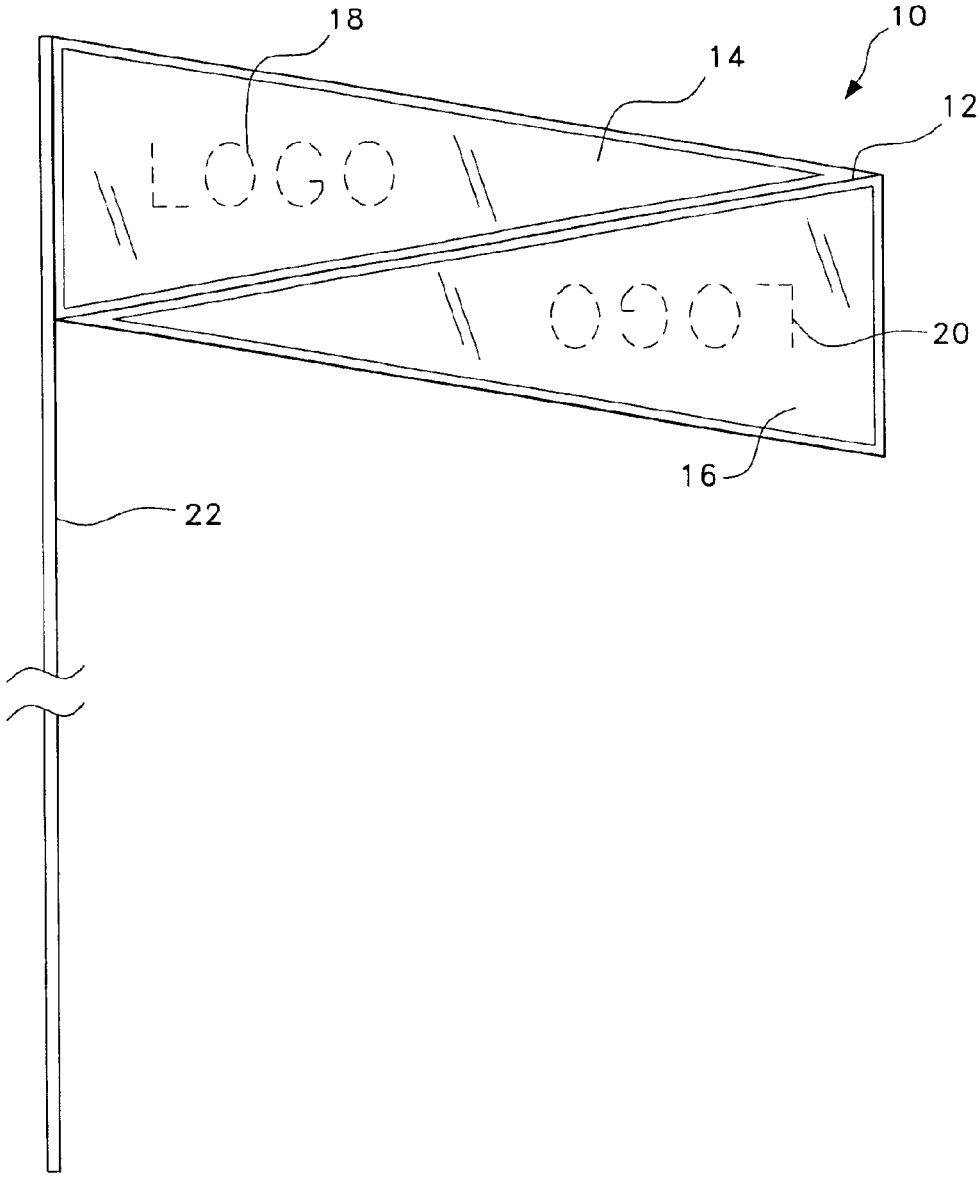
FIG. 1 is a perspective view of a rival flag according to a first embodiment of the present invention.

The present invention relates to a rival flag, generally designated as 10 in the drawings. As is shown in FIG. 1, the rival flag depicts the logo, name, or other identifying indicia of two rival parties. The rival parties can be, for example, opposing athletic teams.

The rival flag 10 is preferably made from a sheet of material having a parallelogram shape. The rival flag 10 can be made from fabric, plastic, metal, or wood. Alternatively, however, the rival flag 10 may be a photographic or computerized image displayed on television or other forms of media. As is shown, a diagonal line 12 divides the parallelogram into first and second complementary, triangular-shaped pennants 14 and 16, respectively. The diagonal line 12 may be defined by any suitable means, including, stitching, drawing, etc. The first pennant 14 has indicia 18 marked thereon representing one team and the second pennant 16 has indicia 20 marked thereon representing an opposing team. The indicia 18 on the first pennant 14 faces a direction opposite from the indicia 20 on the second pennant 16. Thus, when the rival flag 10 is oriented such that the first pennant 14 is on top and the second pennant 16 is on the bottom, indicia 18 on, the first pennant 14 is displayed right side up, while indicia 20 on the second pennant 16 is displayed upside down. When the rival flag 10 is oriented such that the second pennant 16 is on top and the first pennant 14 is on the bottom, indicia 20 on the second pennant 16 is displayed right side up, while indicia 18 on the first pennant 14 is displayed upside down.

By orienting the rival flag 10 such that the indicia associated with the winning team is right side up, the rival flag 10 may be used to indicate the winner or winning team of two opposing teams. For example, the rival flag 10 may be displayed at an athletic event to indicate which team is in the lead or which team is the winner. Similarly, merely an image of the rival flag 10 may be portrayed on television or other forms of media to indicate the winner or winning team. Alternatively, however, the rival flag 10 may itself be utilized as part of a separate game between two parties. For example, two parties who possess the rival flag 10 and support opposing teams depicted on the flag 10 can agree that the party supporting the losing team must display the rival flag 10 where it can be easily seen by others, such that the winning team's pennant is displayed on top. The rival flag 10 must be displayed in this fashion until the two opposing teams meet again in competition. Displaying the rival flag 10 in this manner will serve to disgrace the supporter of the losing team while honoring the supporter of the winning team.

In the embodiment depicted in FIG. 1, the rival flag 10 is configured as a conventional flag. Although not necessary, the rival flag 10 may include a vertical support 22 such as a pole, which may be attached to either side edge of the rival flag 10. Alternatively, however, the rival flag 10 may be hung on a wall or other support structure. The rival flag 10 is preferably made from a sheet of flexible material such as a flexible fabric or plastic.

Figure 2:
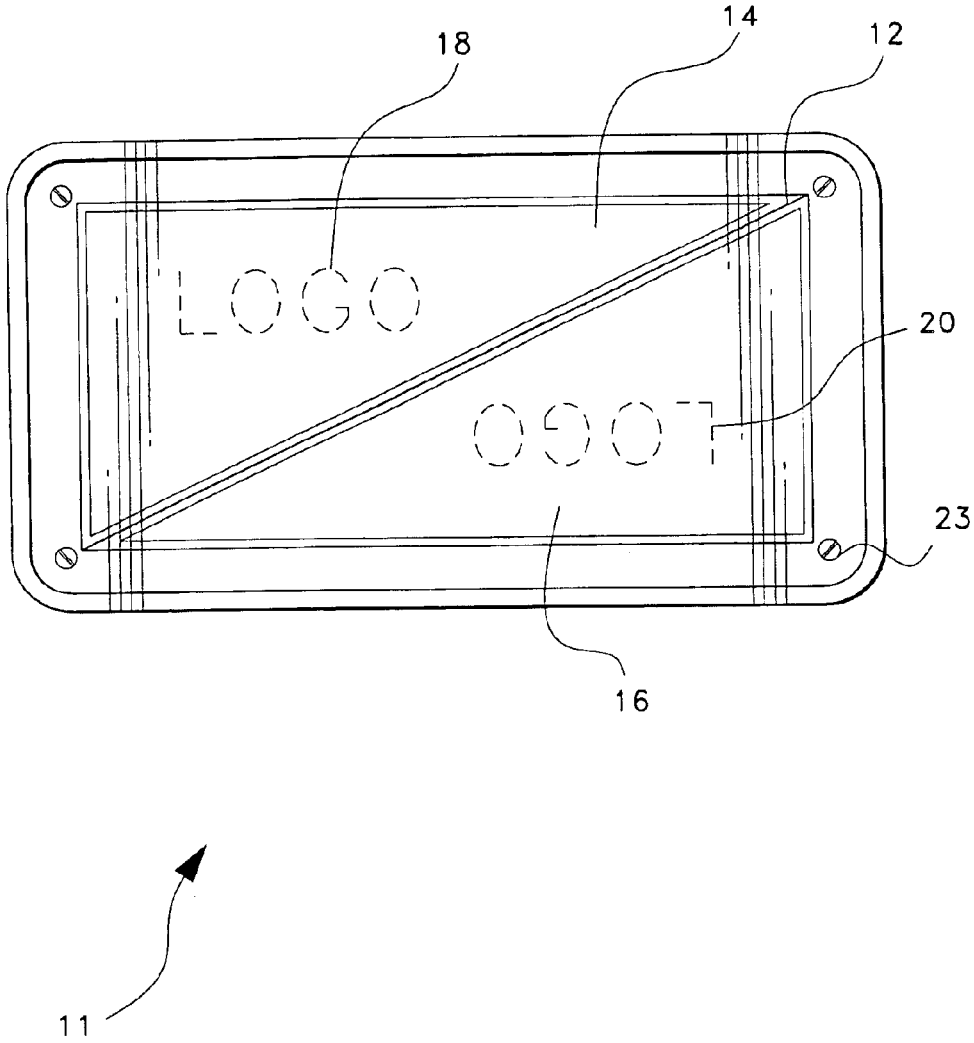
FIG. 2 is a front view of a rival flag according to a second embodiment of the present invention.

FIG. 2 depicts an alternative embodiment of the rival flag, designated as 11 in the drawings. The rival flag 11 is identical to the rival flag 10, except that the rival flag 11 is configured as a license plate and is preferably made from metal. As is shown, the rival flag 11 may have screws 23 inserted therethrough for affixing the rival flag 11 to a car bumper.

Figure 3A:
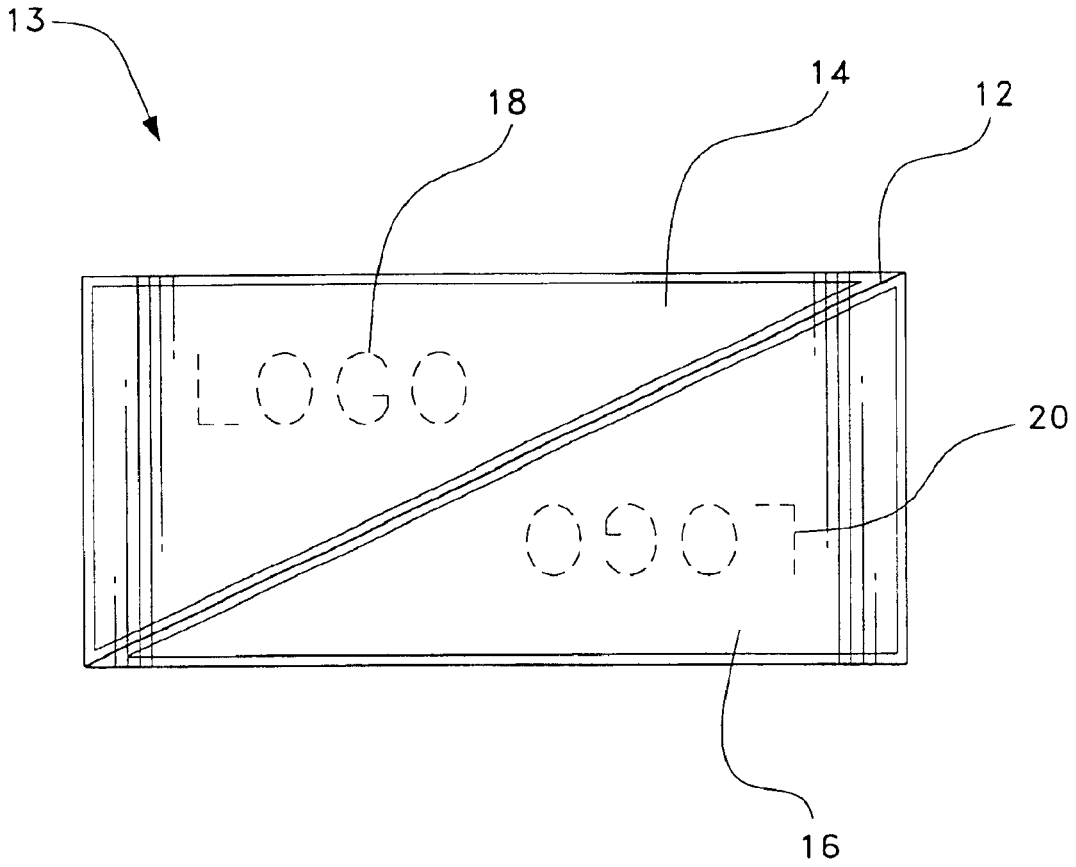
FIG. 3A is a front view of a rival flag according to a third embodiment of the present invention.
Figure 3B:
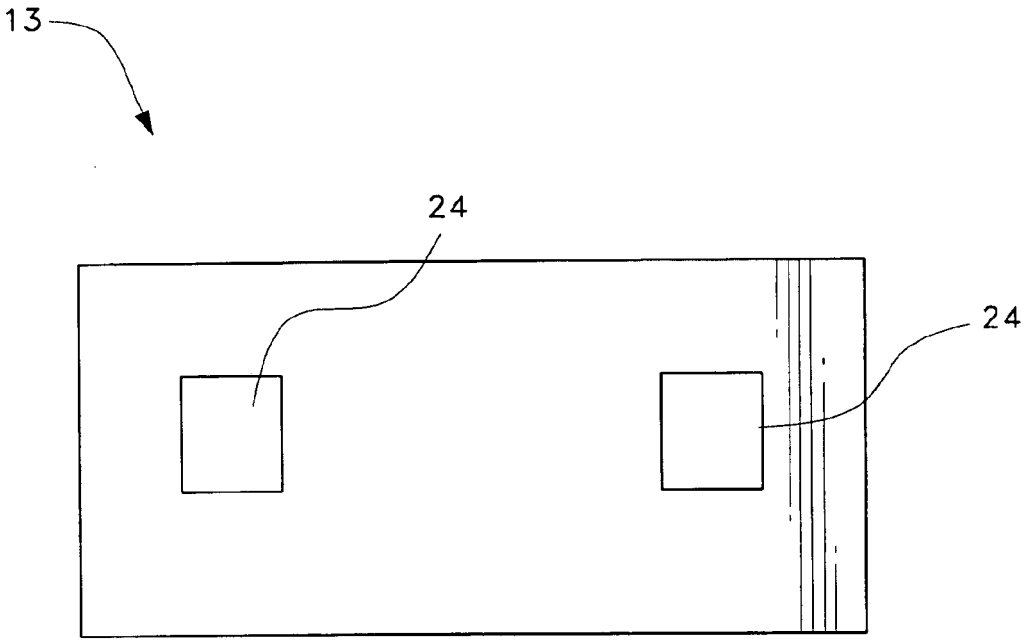
FIG. 3B is a rear view of the rival flag according to a third embodiment of the present invention.

FIGS. 3A–3B depict yet another embodiment of the rival flag, designated as 13 in the drawings. The rival flag 13 may be used as a refrigerator magnet or the like. FIG. 3A depicts a front view of the rival flag 13. The rival flag 13 is identical to the rival flag 10, except that the rival flag 13 is preferably made from a rigid material, such as a rigid plastic, metal, or wooden material and has magnets 24 affixed to its rear surface, as can be seen in FIG. 3B. Alternatively, however, the rival flag 13 may itself be constructed from a magnetic material, thereby eliminating the need for attaching magnets thereto.

It is to be understood that the present invention is not limited to the embodiments described above, but encompasses any and all embodiments within the scope of the following claims.

We claim:

1. A rival flag, comprising:

a sheet of material having the shape of a parallelogram;

a diagonal line dividing at least one face of said parallelogram into first and second complementary, triangular pennants, the first pennant having indicia marked thereon facing a first direction, the second pennant having indicia marked thereon facing a second direction opposite the first direction;

wherein the indicia on the first and second pennants represent opposing athletic teams.

2. The rival flag according to claim 1, wherein said sheet of material is made from fabric.

3. The rival flag according to claim 1, wherein said sheet of material is made from plastic.

4. The rival flag according to claim 1, wherein said sheet of material is made from metal.

5. The rival flag according to claim 4, further including fasteners attachable to said sheet of material for affixing said sheet of material to a supporting surface.

6. The rival flag according to claim 5, wherein said sheet of material is configured as a license plate, said fasteners comprising screws for affixing said sheer of material to a vehicle.

7. The rival flag according to claim 5, wherein said fasteners comprise magnets for attaching said sheet of material to a ferromagnetic support.

8. The rival flag according to claim 1, wherein said sheet of material is made from wood.

9. The rival flag according to claim 1, further including a vertical support attached to a side edge of the rival flag.

10. The rival flag according to claim 9, wherein said vertical support is a pole.

11. The rival flag according to claim 1, further including detachable magnets affixed to its rear surface.

12. The rival flag according to claim 1, wherein the rival flag is constructed from a magnetic material.

13. A method for identifying a winning team from amongst two opposing athletic teams comprising the steps of:

displaying an image of a parallelogram having a diagonal line extending across the parallelogram and dividing the parallelogram into first and second triangular pennants, the first pennant having indicia marked thereon facing a first direction and representing a first team, the second pennant having indicia marked thereon facing a second direction and representing a second team, the first direction being opposite the second direction;

orienting the parallelogram such that the indicia representing the winning team is displayed right side up and the indicia representing the losing team is displayed upside down.

* * * * *